United States Patent [19]

Silva

[11] 4,123,872

[45] Nov. 7, 1978

[54] TOY ANIMAL FIGURES

[76] Inventor: Teiko Silva, R.R. 2, Box 2377A, Florida Trail, Presidential Lakes, Browns Mills, N.J. 08015

[21] Appl. No.: 842,255

[22] Filed: Oct. 14, 1977

Related U.S. Application Data

[62] Division of Ser. No. 651,917, Jan. 23, 1976, abandoned.

[51] Int. Cl.[2] ..... A63H 3/04

[52] U.S. Cl. ..... 46/123; 46/151

[58] Field of Search ..... 46/123, 151, 156

[56] References Cited

U.S. PATENT DOCUMENTS

| | | | |
|---|---|---|---|
| 2,044,949 | 6/1936 | Levy et al. | 46/151 |
| 3,395,484 | 8/1968 | Smith | 46/151 |

*Primary Examiner*—Louis G. Mancene
*Assistant Examiner*—Robert F. Cutting
*Attorney, Agent, or Firm*—Samuel Lebowitz

[57] ABSTRACT

Toy animal figures built up of pliable wire, paper tissue, adhesive masking tape and yarns. A skeletal framework of wire, constituted by two lower parts forming the body and leg portions, and one upper part forming the body, neck, head and tail portions, are bound together and padded by successive coils of paper tissue, adhesive masking tape and closely wound coils of textile yarns. The animal body is then finished by affixing a plurality of pompons to the ends of the body, tail, head and legs, with additional complements of ribbon, simulated eyes and nose, to the head and neck of the toy animal.

2 Claims, 5 Drawing Figures

Fig. 1
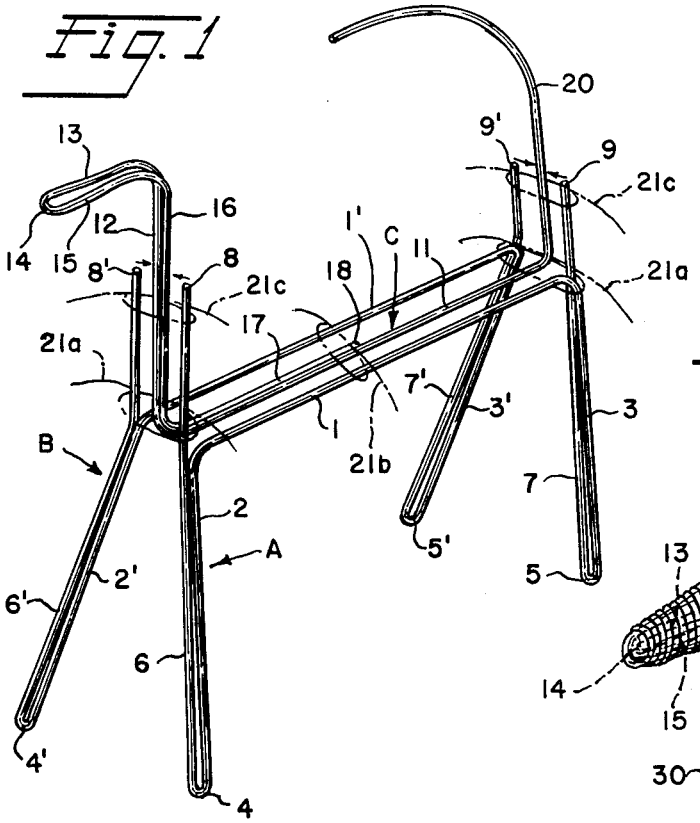
Fig. 4
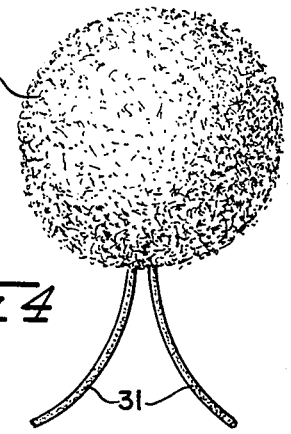
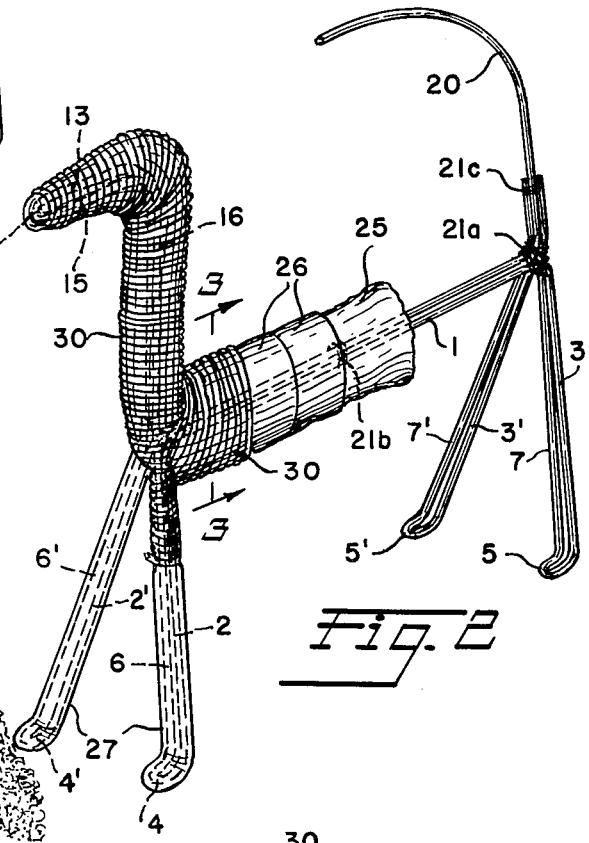
Fig. 2
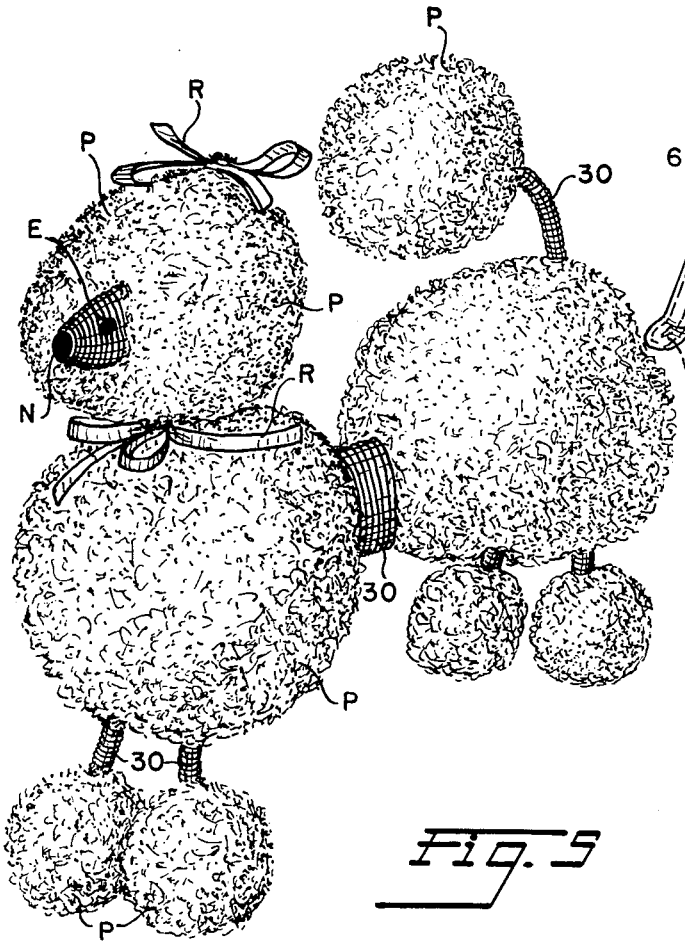
Fig. 5
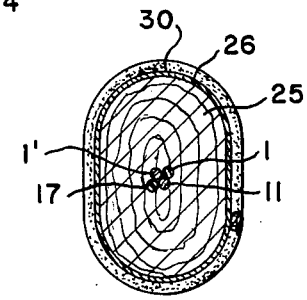
Fig. 3

TOY ANIMAL FIGURES

This is a division of application Ser. No. 651,917, filed Jan. 23, 1976, now abandoned.

This invention relates to the fabrication of toy animal figures, and more particularly such figures which may be produced by hand from continuous supplies of pliable wire, paper tissue, adhesive masking tape and yarns.

It is the object of the present invention to provide improved constructions of toy animal figures and methods of their production, which make possible the attainment of a wide diversification of simulated animal species, as well as their sizes. Not only do the toy animals lend themselves to variation in the course of production, but their pliability renders possible limited changes in the outlines of the animal bodies in accordance with the wishes of the ultimate user.

It is another object of the invention to provide toy animal figures formed of low-cost materials with no waste. The animal toys are sufficiently rugged to withstand repeated handlings over long periods of time without deterioration of their component parts.

It is another object of the invention to improve upon the methods of fabrication of toy animal figures and the resultant assemblies over those known in the prior art as disclosed in U.S. Pat. Nos. 2,044,949, June 23, 1936; 2,073,723, Mar. 16, 1937; and 2,812,616, Nov. 12, 1957.

Other objects and purposes will appear from the detailed description of the invention following hereinafter, taken in conjunction with the accompanying drawings, wherein FIG. 1 is an exploded perspective view of the skeletal framework of a toy animal preparatory to the combining together of the three essential frame components thereof;

FIG. 2 is a perspective view of the combined skeletal framework with illustrations of successive stages in the production of the toy animal;

FIG. 3 is a vertical sectional view along line 3—3 of FIG. 2;

FIG. 4 is a front elevation of a pompon, many of which are used in the final finishing of the toy animal figures; and FIG. 5 is a perspective view of one embodiment of the finished animal figure following the application of the ornamental pompons as well as ribbons, eyes and nose thereto.

The drawings show a poodle which is illustrative of many species of toy animals which may be created from low-cost materials such as pliable wire, paper tissue, adhesive masking tape and yarns, all of which may be drawn from reels or spools as needed, without waste of any of these materials. The concinuous supply of materials makes possible the variation of the size of the toy animals without need for special patterns or dies.

In the example illustrated in the drawings, the animal shown in FIG. 5 may assume a dimension of approximately one foot long and one foot high by starting with the production of a skeletal framework of wire, as shown in FIG. 1. This skeletal framework is formed of three complementary parts consisting of two identical lower parts A and B, and a third upper part C. The wire from which these complementary parts are bent may be of varying gauge, for example, gauge Nos. 19 to 21, which is readily pliable to permit its bending, and yet sufficiently rugged to be self-supporting, as shown in FIG. 1. In the larger sizes of the toy animals, in order to increase the pliability of the starting wires and the ultimate product, the wires may be of multiple strand, for example, four-strand construction.

Part A in FIG. 1 is formed of an intermediate length 1 of approximately five and one-half inches, with leg portions extending downwardly from the opposite ends thereof for approximately five inches. The leg portion 2, extending downwardly from the forepart of body portion 1, is bent at reentrant loop 4 into length 6 which runs upwardly for about eight inches and terminates at point 8. The rearward leg portion 3, at the opposite end of the body portion 1, is bent at reentrant loop 5 into length 7 which runs about six inches and terminates at point 9. The companion leg portion B is identical to leg portion A and the parts thereof have been designated with the same reference characters as the parts of A with the addition of a prime designation, i.e., 1', 2', 3', etc.

The third complementary part of the skeletalized framework, namely, the upper part, consists of the body portion 11 of about five and one-half inches in length, from the rearward end of which is bent the tail 20 for approximately 9½ inches. The forepart of the body portion 11 is bent upwardly into a neck portion along the length 12 for approximately 4 inches wherefrom the head portion is bent transversely into length 13, loop 14 and wire length 15 which is turned downwardly at 16 adjacent to wire length 12 and is again bent transversely into wire 17 for approximately one-half the length of the body portion 11, which terminates at 18.

Thereafter, the three complementary parts of the skeletal framework are bound together, preferably with thin wire, for example No. 24 gauge, to integrate the skeletalized framework into a single unit, as shown at the right portion of FIG. 2 and indicated in FIG. 1. The bindings **21*a* at the opposite ends of the body portions are the most essential and these may be supplemented by another binding 21*b* at an intermediate point of the body portions, which preferably embraces wire 17. Additional bindings 21*c*** at the front and rear of the skeletal framework serve to tie together the upwardly extending wires of the leg portions with the neck portion at the front of the framework and the tail at the rear portion thereof.

Following the binding of the three complementary parts of the framework together, layers of tissue, which may be facial tissue, toilet tissue, or wrapping tissue, are rolled along the body portion, as shown at 25, and in the case of a large size toy animal as shown in the drawings, around the neck and head portions. In the illustrated embodiment, the layer of tissue paper at the body portion in FIG. 2 may be built up to a diameter of about 1½ inches, the neck portion 1 inch, and the head portion one-half inch.

Immediately thereafter, the adhesive masking tape 26 is rolled around the body of paper tissue, as shown in FIG. 2, which retains the padded body portions in place, both in the main body portion, as well as in the neck and head portions. This masking tape may be of paper, of approximately 1 inch in width, which may be coiled conveniently around the padded body portions. This masking tape also lends itself to simple superposition on the lengths of wire which are not covered with tissue by merely folding lengths thereof around the wire, as indicated at 27 at the forepart of FIG. 2. The layer of masking tape in this form, as well as the spiral layers of masking tape on the body portions, provide a workable base for closely juxtaposed coils of yarn 30 onto the framework. These coils may be anchored at the ends of the body, neck, head, legs and tail, in any desired way as the yarn is changed in direction, and these may be of discontinuous length for each of the body parts.

Following the complete encasement of the built-up toy animal with closely wrapped coils of the yarn over the body, neck and head portions, as well as the leg and tail portions, pompon ornaments P, of the type shown in FIG. 4, are tied or threaded into the animal body by means of the tie strings 31 extending from the body of each pompon. The pompons may vary in size by varying the lengths of the yarns from which they are produced, for example, large pompons may be prepared from five inch lengths of yarn, while small pompons may be prepared from 3½ inch lengths of yarn. Four of these large units may be tied into the rear of the body portion adjoining the legs and tail, while three of these large size units may be tied into the forepart of the body portion at the junction of the neck and front legs. A single pompon may be attached to the free end of the tail and above each one of the feet at the free ends of the legs which may be bent forwardly for about one-half inch to simulate the feet of the animal. Additionally, three small pompons are tied into the coils of yarn at the junction of the neck and head portions, one on each side, and a third one at the top of the latter, which merge into each other to outline the head.

Simulated eyes E and a colored disc N are affixed by any suitable adhesive to the forepart of the head to simulate the eyes and nose of the toy animal, and finally, ornamental ribbons R may be tied to the top of the head and neck of the animal, as shown in FIG. 5.

The materials required for the construction of the toy animal as described above are of low cost. The main body of the toy animal described above, requires about 9 feet of multiple strand wire and about 2 feet of light wire for binding purposes. About six ounces of three-ply yarn and about thirteen feet of masking tape, with slight amounts of paper tissue, ribbon, etc., are also included in the assembly.

Smaller toy animals may be produced by reducing the corresponding dimensions of the three main components of the skeletalized frame. A six-inch poodle may be produced from frame elements in which the body portion is 3 inches, the tail 5 inches, the neck portion 2 inches and the head portion 1 inch, with the padding of the frame correspondingly reduced to form a body portion one inch in diameter, a neck portion of one-half inch and a head portion of one-quarter inch in diameters. Of course, the leg portions are also correspondingly reduced to two and one-half inches which are covered with masking tape to provide a base for the turns of the coiled yarn. The simulated animals may be wound with a solid color yarn, such as black, and the decorative pompons of a similar solid color. The ribbons may be of a contrasting color, such as white.

If desired, the color components may be varied to attain different effects. Thus, to emphasize the Bicentennial motif, the pompons, as well as the visible turns of yarn on the body, tail and neck portions may include yarns of red, white and blue colors.

I claim:

1. The method of making toy animal figures from pliable wire, paper tissue, adhesive masking tape and yarns, which comprises (a) forming a wire skeletal framework by bending two integral lengths of wire into a central medial body portion with leg portions bent transversely therefrom at the opposite ends thereof, and with each leg formed with a reentrant loop at its lowermost end with the wire terminating at each free end above the body portions, and bending a single length of wire in a central medial body portion, substantially coextensive with said first-mentioned body portions, and with a tail portion extending upwardly from one end thereof and a neck portion extending upwardly from the opposite end thereof with a transversely extending head portion at the upper end of said neck portion, (b) binding together said three bent wire components at a plurality of points, with thin binding wire, (c) wrapping paper tissue around at least said body portion to increase the bulk thereof and encasing said paper tissue and the remainder of the skeletal framework with adhesive masking tape, (d) winding yarn spirally in closely contacting coils around the adhesive masking tape, and (e) affixing ornamental components of yarn to said spiral windings at different parts thereof to simulate different species of animal pets.

2. The method set forth in claim 1, which includes wrapping paper tissue around the neck and head portions in addition to the body portion prior to the wrapping of adhesive masking tape therearound.

* * * * *